US010790638B2

(12) United States Patent
Kawai

(10) Patent No.: US 10,790,638 B2
(45) Date of Patent: Sep. 29, 2020

(54) SPARK PLUG FOR INTERNAL COMBUSTION ENGINE USE AND METHOD OF MANUFACTURING SPARK PLUG

(71) Applicant: DENSO CORPORATION, Kariya, Aichi-pref. (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/748,075

(22) Filed: Jan. 21, 2020

(65) Prior Publication Data

US 2020/0235551 A1 Jul. 23, 2020

(30) Foreign Application Priority Data

Jan. 22, 2019 (JP) ..... 2019-008329

(51) Int. Cl.
*H01T 13/02* (2006.01)
*H01T 21/02* (2006.01)

(52) U.S. Cl.
CPC ..... *H01T 13/02* (2013.01); *H01T 21/02* (2013.01)

(58) Field of Classification Search
CPC ..... H01T 13/02; H01T 21/02
See application file for complete search history.

(56) References Cited

U.S. PATENT DOCUMENTS 6,357,274 B1 * 3/2002 Tanaka ..... B21C 23/20 72/355.6
6,548,945 B1 4/2003 Tamura

* cited by examiner

*Primary Examiner* — Anne M Hines
(74) *Attorney, Agent, or Firm* — Nixon & Vanderhye PC

(57) ABSTRACT

An outer periphery of the tubular housing includes a parallel surface, a pressure contact surface and a connection surface. The parallel surface is formed parallel to an axial direction of the spark plug. The pressure contact surface is located closer to a tip of the spark plug and more radially inward than the parallel surface. The pressure contact surface has a tapered shape in that a diameter decreases toward the tip. The pressure contact surface is pressed against a cylinder head when installed in the internal combustion engine. The connection surface is located closer to a base of the spark plug than an extension line in a longitudinal cross-section of the spark plug parallel to the axial direction including a plug central axis. The connection surface connects an outer peripheral end of the pressure contact surface with a longitudinal end of the parallel surface.

6 Claims, 15 Drawing Sheets

SPARK PLUG FOR INTERNAL COMBUSTION ENGINE USE AND METHOD OF MANUFACTURING SPARK PLUG

CROSS-REFERENCE TO RELATED APPLICATION

This patent application is based on and claims priority to Japanese Patent Application No. 2019-008329, filed on Jan. 22, 2019 in the Japan Patent Office, the entire disclosure of which is hereby incorporated by reference herein.

BACKGROUND

Technical Field

The present disclosure relates to a spark plug used in an internal combustion engine and a method of manufacturing the spark plug.

Related Art

In an internal combustion engine such as an automobile engine, etc., a spark plug is used as an ignition system. The spark plug is attached to a cylinder head by screwing a mounting screw provided in an outer periphery of the spark plug into a female screw formed in a plug hole of the cylinder head. When the spark plug is attached to the cylinder head, a discharge gap formed at a tip of the spark plug is located in a combustion chamber.

In such a situation, when a gas in the combustion chamber leaks out of the combustion chamber between the female screw and the spark plug, malfunction of the engine occurs. Hence, airtightness is required between the spark plug and the cylinder head.

In view of this, an outer periphery of a housing of a conventional spark plug has a circular pressure contact surface pressed against a seat surface formed in a cylinder head. The seat surface of the cylinder head is formed in a tapered state extended toward an outer periphery thereof toward a base thereof. The pressure contact surface of the spark plug is also formed in a tapered state so as to face the seat surface. The pressure contact surface is pressed against the seat surface by screwing a mounting screw into a female screw provided in the plug hole of the cylinder head thereby generating longitudinal force. Hence, both adhesion between the pressure contact surface and the seat surface and airtightness between the spark plug and the cylinder head are ensured.

However, the international standard ISO 28741:2013 regulates that a taper angle between seat surfaces of a cylinder head is 60 degrees +0/−1 degrees, and a taper angle between pressure contact surfaces of a spark plug is 63 degrees ±0.1 degrees. That is, the standard regulates that the taper angle of the pressure contact surface of the spark plug is larger than the taper angle of the seat surface of the cylinder head. Thus, when the spark plug is attached to the cylinder head, an outer periphery of the pressure contact surface of the spark plug is necessarily pressed against the seat surface of the cylinder head.

Here, a circular pressure contact surface formed on the outer periphery of the housing of the conventional spark plug is extended from a tip of a cylindrical parallel surface (herein below simply referred to as a parallel surface) parallel to an axis. Hence, since an angular portion formed on the outer periphery of the pressure contact surface (i.e. a corner between the pressure contact surface and the parallel surface) is radially positioned at the parallel surface, the angular portion is relatively closer to the outer periphery of the housing. When the corner is positioned relatively closer to the outer periphery of the housing, other objects are likely to interfere with the corner, for example, during a manufacturing process of manufacturing the spark plug. As a result, the corner including an outer peripheral edge of the pressure contact surface can have dents.

Specifically, when barrel metal plating is applied to the housing, the corner can be hit thereby having the dent thereon. That is, in the barrel metal plating, multiple pre-metal plating housings are installed in a basket called a barrel containing metal plating solution, and the barrel is rotated to apply metal plating to surfaces of respective housings. This barrel metal plating is highly productive at low cost when preparing the housings, because many housings can be plated at once. On the other hand, however, due to collision between the housings in the barrel, dents can be made on the housing surfaces. In particular, because it has a square shape on the relatively outer periphery of the housing between the pressure contact surface and the parallel surface of the housing, the corner easily interferes with other housings or the like during the barrel metal plating, thereby probably suffering a dent thereon.

When an unevenness (e.g., a dent) is formed on the corner including the outer peripheral edge of the pressure contact surface, adhesion between the outer peripheral edge of the pressure contact surface and the seat surface of the cylinder head is likely to be reduced. As a result, airtightness between the spark plug and the cylinder head can be decreased.

The present invention has been made to address such problems and an object thereof is to provide a spark plug used in an internal combustion engine enabled to ensure airtightness between the spark plug and the cylinder head.

SUMMARY

Accordingly, one aspect of the present disclosure provides a novel spark plug used in an internal combustion engine. The spark plug has a tubular housing. An outer periphery of the tubular housing includes: a parallel surface formed parallel to an axis of the spark plug and a circular pressure contact surface located closer to a tip of the spark plug and radially inward more than the parallel surface. The pressure contact surface has a tapered shape in that a diameter decreases towards the tip. The pressure contact surface is pressed against a cylinder head. The outer periphery of the tubular housing further includes a connection surface to connect an outer peripheral edge of the pressure contact surface with an end of the parallel surface. The connection surface is located closer to a base of the spark plug than an extension line extended along and away from the pressure contact surface.

Another aspect of the present disclosure provides a novel method of producing a spark plug for internal combustion engine. The method comprises the step of forming an inclined surface inclined to a radially outward from the body of the spark plug toward a base thereof as a preparation step. A part of the inclined surface becomes a pressure contact surface to be pressed against a cylinder head. The method further comprises the step of forming a cylindrical surface parallel to a longitudinal direction from an outer peripheral edge of the inclined surface toward the base in the preparation step. A part of the cylindrical surface becomes a parallel surface. The method further comprises the step of applying barrel plating to the housing substrate as a barrel plating step. After completing the barrel plating step, the method further comprises the step of applying machining to a substrate corner caused during the preparation step on a border between the inclined surface and the cylindrical surface until the substrate corner is deformed into the connection surface while the inclined surface and the cylindrical surface are changed to the pressure contact surface and the parallel surface, respectively.

Yet another aspect of the present disclosure provides a novel method of producing a spark plug for an internal combustion engine, which includes a housing that accommodates a cylindrical porcelain insulator and is caulked at its base. To prepare a housing substrate, the method comprises the step of forming an inclined surface inclined radially outward from the body of the spark plug toward a base of the spark plug as a preparing step. A part of the inclined surface becomes a pressure contact surface. The method further comprises the step of forming a cylindrical surface parallel to a longitudinal direction of the spark plug from an outer peripheral edge of the inclined surface toward the base also as a preparing step. A part of the cylindrical surface becomes a parallel surface. The method further comprises the step of applying barrel plating to the housing substrate as a barrel plating step. After completing the barrel plating step, the method further comprises the step of forming an assembly at least by inserting a porcelain insulator into the housing substrate as an insertion step. The method further comprises the step of bringing a substrate corner caused during the preparing step on a border between the inclined surface and the cylindrical surface into contact with a supporting surface formed parallel to the connection surface in an inner periphery of a tubular supporting jig from above the supporting surface in a first contacting step. The method further comprises the step of bringing a caulking jig into contact with the base of the housing substrate from above the base of the housing substrate in a second contacting step. After completing the first contacting step and the second contacting step, the method further comprises the step of applying a compressive force to the housing substrate in the longitudinal direction by bringing the supporting jig and the caulking jig close to each other in the longitudinal direction as a simultaneous processing step until the base of the housing substrate is plastically deformed and a caulked portion is formed by the compressive force. The method further comprises the step of simultaneously pressing a substrate corner against the supporting surface by the compressive force until the substrate corner is plastically deformed into a connection surface facing the supporting surface while the inclined surface and the cylindrical surface are changed to a pressure contact surface and a parallel surface, respectively.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

Figure 1:
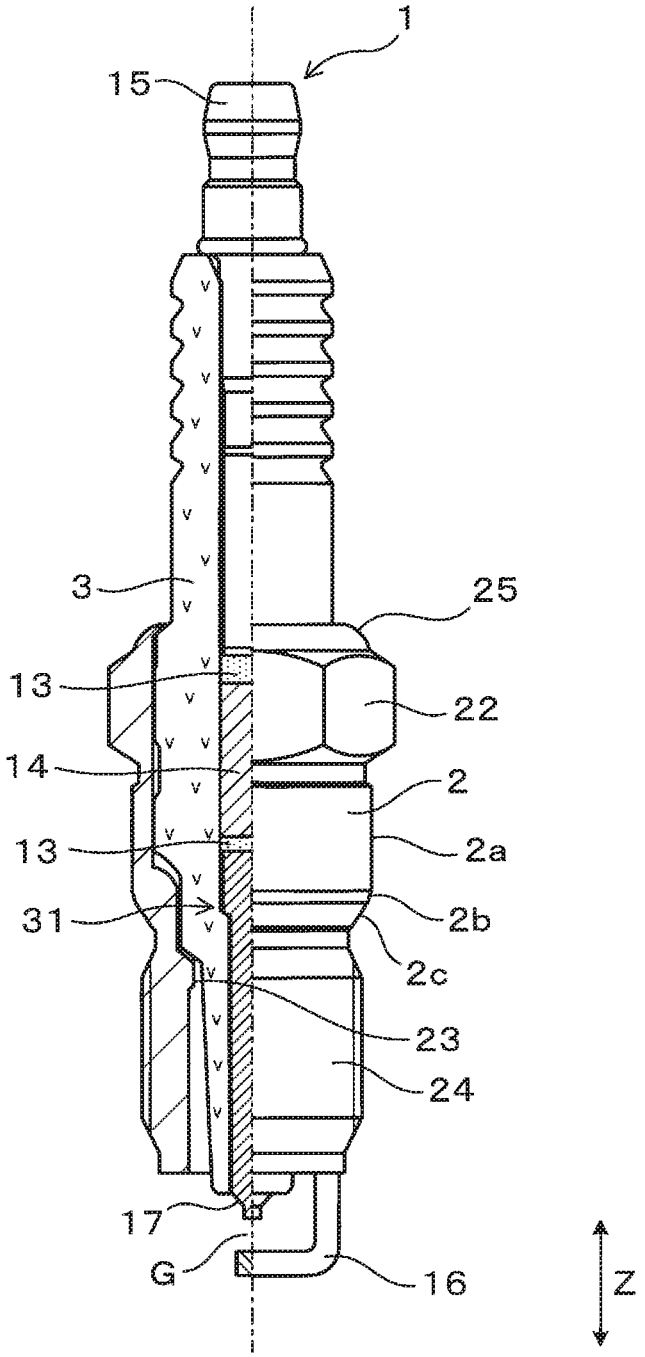
FIG. 1 is a partial cross-sectional front view illustrating an exemplary spark plug according to a first embodiment of the present disclosure.

Referring now to the drawings, wherein like reference numerals designate identical or corresponding parts throughout the several views thereof, and to FIGS. 1 to 10, a first embodiment of a spark plug used in an internal combustion engine and its manufacturing method are described.

First, as shown in FIG. 1, the spark plug 1 used in the internal combustion engine of this embodiment includes a tubular housing 2. As shown in FIGS. 1 to 4, an outer periphery of the housing 2 has a circular parallel surface 2*a* (herein below simply referred to as a parallel surface 2*a*), a circular pressure contact surface 2*c* (herein below simply referred to as a pressure contact surface 2*c*) and a circular connection surface 2*b* (herein below simply referred to as a connection surface 2*b*) connecting these faces with each other.

Figure 5:
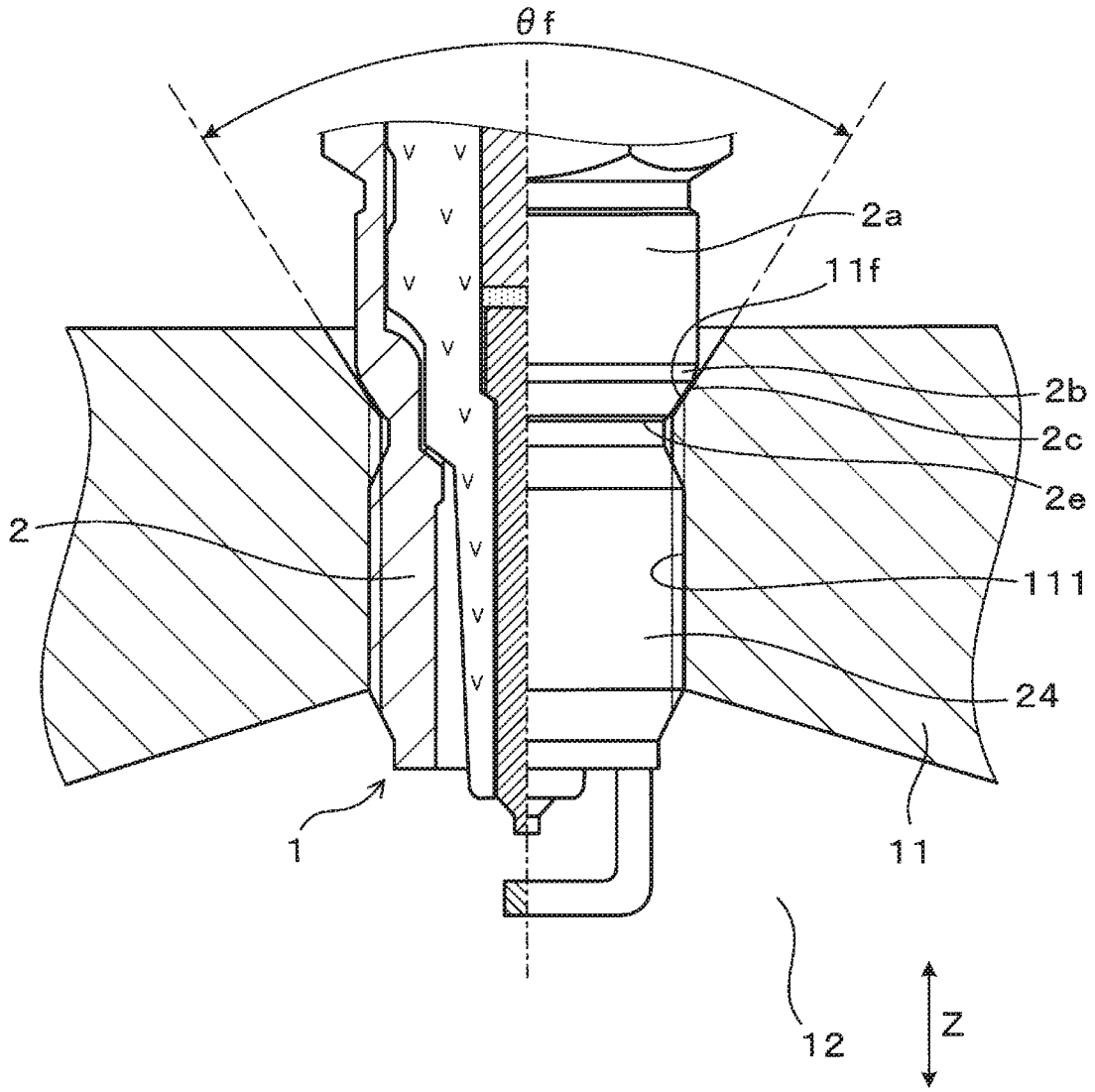
FIG. 5 is a partial cross-sectional front view illustrating an ignition system composed of an internal combustion engine and the spark plug of the first embodiment attached to the internal combustion engine.

The pressure contact surface 2*c* is disposed closer to a tip of the spark plug 1 than the parallel surface 2*a* is and radially inside an extension line extended along and away from and away from an outer periphery of the parallel surface 2*a*. The pressure contact surface 2*c* is formed in a tapered state in which a diameter reduces toward the tip of the spark plug 1. As shown in FIG. 5, when the spark plug 1 is attached to the internal combustion engine, the pressure contact surface 2*c* is pressed against a cylinder head 11 of the internal combustion engine.

Figure 2:
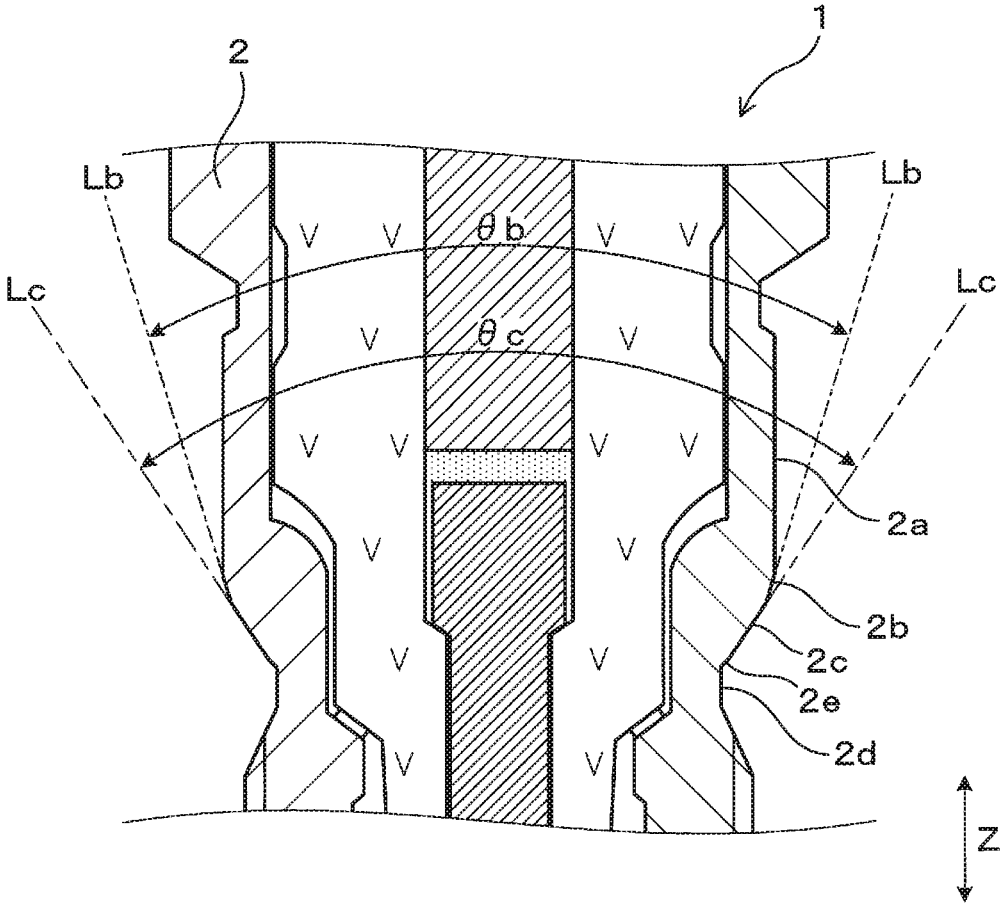
FIG. 2 is an enlarged longitudinal cross-sectional view illustrating a connection surface formed in the spark plug and a periphery thereof according to the first embodiment.

Further, as shown in FIG. 2, in the longitudinal cross-section of the spark plug 1, the connection surface 2*b* is positioned radially inside an extension line Lc extended along and away from the pressure contact surface 2*c*. Here, the longitudinal cross-section of the spark plug 1 is extended in the longitudinal direction Z including a plug central axis as shown in FIG. 2. The connection surface 2*b* is configured to connect a tip of the parallel surface 2*a* and an outer peripheral edge of the pressure contact surface 2*c* with each other.

More specifically, the spark plug 1 can be used as an ignition system in an internal combustion engine mounted on an automobile or a cogeneration system and the like. One end of the spark plug 1 in the longitudinal direction Z is connected to an ignition coil (not shown), the other end of the spark plug 1 in the longitudinal direction Z is disposed in a combustion chamber 12 of the internal combustion engine (see FIG. 5).

Herein below, when it is simply referred to, a longitudinal direction Z means a longitudinal direction of the spark plug 1 unless otherwise particularly mentioned. Further, one side of the spark plug 1 inserted first into the combustion chamber 12 in the longitudinal direction Z is referred to as a tip side. By contrast, the other side opposite thereto is referred to as a base side. Further, when it is simply referred to, a radial direction means that of the spark plug 1.

The housing 2 is formed in a cylindrical (i.e., tubular) state and made of heat-resistant conductive material, such as iron, nickel, iron-nickel alloy, stainless steel, etc. Although not shown in the drawings, a surface of the housing 2 is plated with nickel or zinc and the like. By applying such metal plating to the surface of the housing 2, a corrosion resistance of the housing 2 can be increased. As described later, the metal plating is applied to the surface of the housing 2 by a barrel metal plating process.

Further, as shown in FIG. 1, on an outer periphery of the housing 2 closer to the tip side thereof, a mounting screw 24 having a screw thread is formed. Hence, as shown in FIG. 5, when the mounting screw 24 is screwed into a female screw 111 provided in a plug hole formed in the cylinder head 11, the spark plug 1 is attached to the cylinder head 11. In a state where the spark plug 1 is attached to the cylinder head 11, the tip of the spark plug 1 is exposed to the combustion chamber 12. In this embodiment, the mounting screw 24 is produced by rolling.

Figure 3:
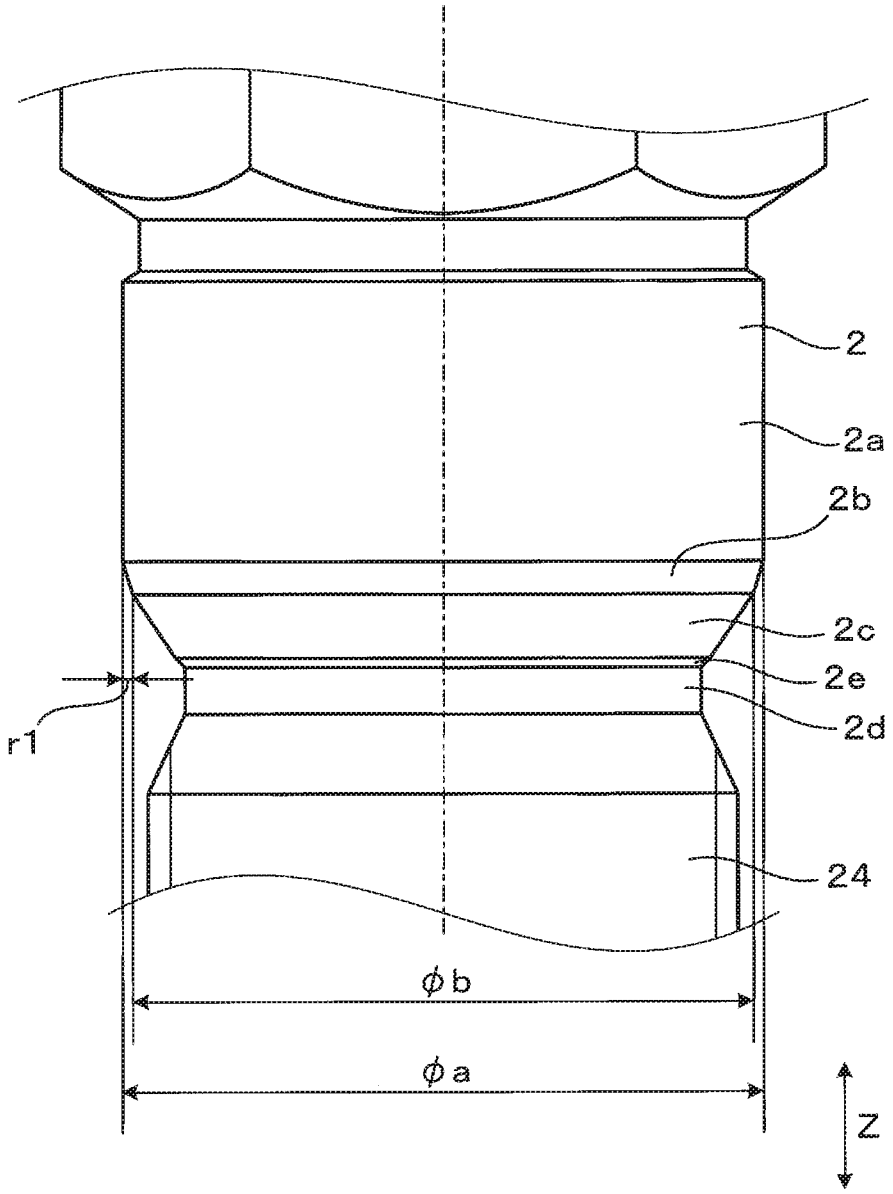
FIG. 3 is an enlarged front view illustrating the connection surface of the spark plug and the periphery thereof according to the first embodiment.
Figure 4:
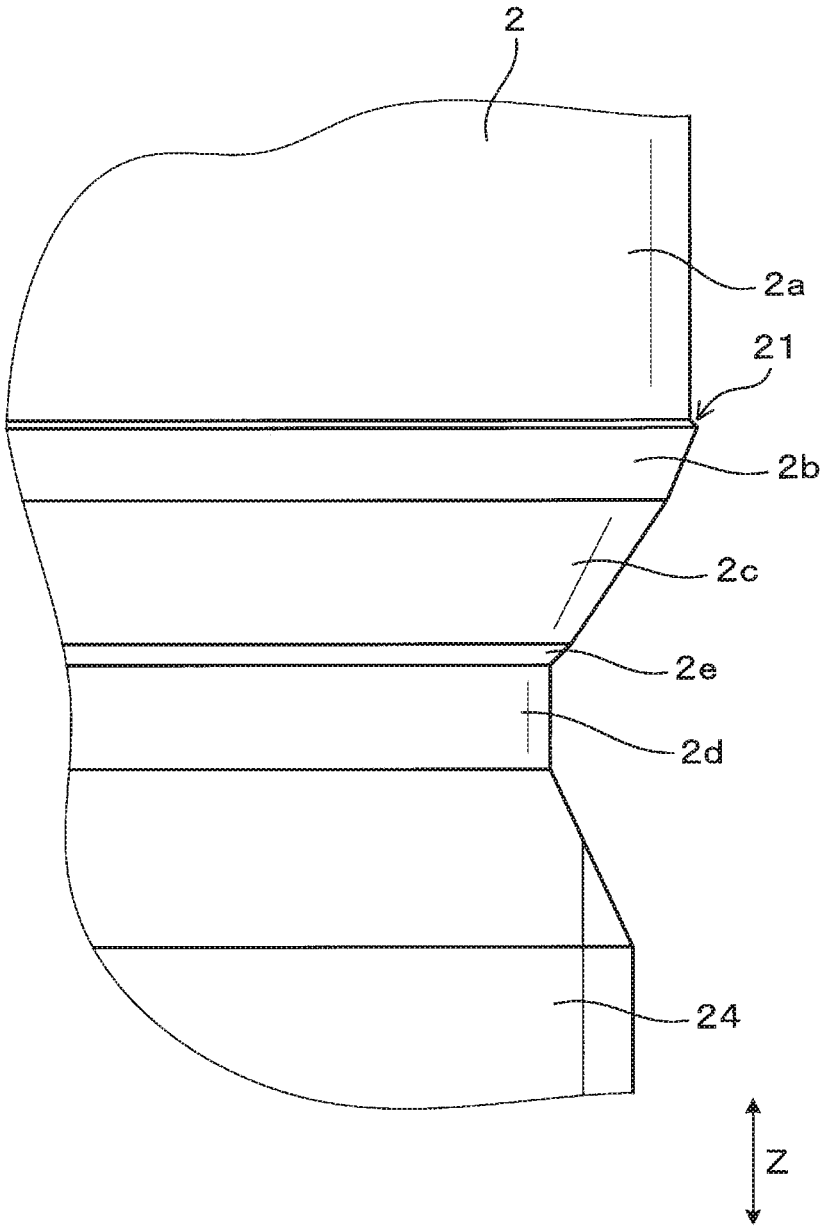
FIG. 4 is a further enlarged front view illustrating the connection surface of the spark plug and the periphery thereof illustrated in FIG. 3.

Further, as shown in FIGS. 2 to 4, the outer periphery of the housing 2 also has a cylindrical thinned surface 2*d* (herein after simply referred to as a thinned surface 2*d*) on a side of the mounting screw 24 closer to the base.

The thinned surface 2*d* has a cylindrical shape parallel to the longitudinal direction Z. The thinned surface 2*d* has a smaller outer diameter than each of respective portions of the housing 2 adjacent to both sides of the thinned surface 2*d* in the longitudinal direction Z. The thinned surface 2*d* serves as an escape groove to accept partial entrance of a die for rolling use when the mounting screw 24 is rolled. Specifically, by providing the thinned surface 2*d*, the die for rolling use is prevented from interfering with a portion other than the mounting screw 24. Further, as shown in FIGS. 3 and 4, the outer periphery of the housing 2 further has an inclined circular connection surface 2*e* (herein after simply referred to as a connection surface 2*e*) connecting the thinned surface 2*d* with the pressure contact surface 2*c*.

The inclined connection surface 2*e* is formed in a tapered shape in which a diameter decreases toward the tip side. Further, the inclined connection surface 2*e* has a taper angle greater than the pressure contact surface 2*c* has. In the longitudinal cross-section, each of the extension lines extended along and away from the inclined connection surfaces 2*e* is linear and parallel to the inclined connection surface 2*e*. As shown in FIG. 5, an outer diameter of the inclined connection surface 2*e* is smaller than an inner diameter of the seat surface 11*f* of the cylinder head 11 as described later in detail. Hence, when the spark plug 1 is attached to the cylinder head 11, the inclined connection surface 2*e* does not contact the cylinder head 11. Further, as shown in FIGS. 2 to 4, the outer periphery of the housing 2 has the above-described pressure contact surface 2*c* adjacent to a side of the inclined connection surface 2*e* closer to the base. The taper angle of the inclined connection surface 2*e* is formed by extension lines therebetween extended along and away from a pair of connection inclined surfaces 2*e* as defined in the longitudinal cross-section. In the longitudinal cross-section, each of the extension lines extended along and away from the connection inclined surfaces 2*e* is linear and parallel to the inclined connection surface 2*e*. As shown in FIG. 5, an outer diameter of the inclined connection surface 2*e* is smaller than an inner diameter of the seat surface 11*f* of the cylinder head 11 as described later in detail. Hence, when the spark plug 1 is attached to the cylinder head 11, the inclined connection surface 2*e* does not contact the cylinder head 11. Further, as shown in FIGS. 2 to 4, the outer periphery of the housing 2 has the above-described pressure contact surface 2*c* adjacent to a side of the inclined connection surface 2*e* closer to the base.

As described earlier, the pressure contact surface 2*c* has the tapered shape that shrinks toward the tip side. That is, in the longitudinal cross-section, the pressure contact surface 2*c* is inclined linearly to a radially inner portion toward the tip side.

As shown in FIG. 2, a pressure contact taper angle θc formed by the pressure contact surfaces 2*c* in the longitudinal cross section is 63 degrees ±1 degrees in conformity to the international standard ISO 28741:2013. That is, the pressure contact taper angle θc is formed by a pair of extension lines Lc extended along and away from the respective pressure contact surface 2*c* in the longitudinal cross-section. That is, in the longitudinal cross-section, the extension lines Lc of the pressure contact surface 2*c* are linear and parallel to the pressure contact surface 2*c*.

Further, as shown in FIG. 5, the pressure contact surface 2*c* is pressed against the seat surface 11*f* formed around an outer periphery of the female screw 111 of the cylinder head 11 closer to the base when the spark plug 1 is attached to the cylinder head 11. The seat surface 11*f* has a tapered shape that narrows toward the tip side. Hence, the pressure contact surface 2*c* is pressed against the seat surface 11*f* of the cylinder head 11 by an axial force generated when the mounting screw 24 is screwed into the female screw 111.

Further, a seat taper angle θf, i.e., a taper angle of the seat surface 11*f* of the cylinder head 11, is 60 degrees +0/−1 degrees also in compliance with the international standard ISO 28741:2013. The seat taper angle θf is formed by a pair of extension lines extended along and away from the respective seat surfaces 11*f* in the longitudinal cross-section when the spark plug 1 is attached to the cylinder head 11. That is, in the longitudinal cross-section, each of the extension lines Lf of the seat surfaces 11*f* is linear and is parallel to the seat surfaces 11*f*.

Accordingly, since the pressure contact taper angle θc is greater than the seat taper angle θf, an outer peripheral edge of the pressure contact surface 2*c* is pressed against the seat surface 11*f* of the cylinder head 11 when the spark plug 1 is attached to the cylinder head 11. Further, as shown in FIGS. 2 to 4, on the outer periphery of the housing 2, the outer peripheral edge of the pressure contact surface 2*c* and the connection surface 2*b* abut to each other.

Further, the connection surface 2*b* has a tapered shape in which a diameter decreases toward the tip side. That is, as shown in FIG. 2, in the longitudinal cross-section, the connection surface 2*b* linearly narrows radially toward the tip side. Further, the connection taper angle θb as the taper angle of the connection surface 2*b* is smaller than the pressure contact taper angle θc. Here, the connection taper angle θb is formed by a pair of extension lines Lb extended along and away from a pair of connection surfaces 2*b* in the longitudinal cross-section.

In this embodiment, the connection taper angle θb is less than 59 degrees. That is, the connection taper angle θb is smaller than 59 degrees, which is less than the minimum angle of 60 degrees +0/−1 degrees provided by the international standard ISO 28741:2013 as a seat surface taper angle θf of the cylinder head 11. Hence, as shown in FIG. 5, when the spark plug 1 is attached to the internal combustion engine, the connection surface 2*b* does not contact the seat surface 11*f*. Further, as shown in FIGS. 2 to 4, the outer periphery of the housing 2 has the above-described parallel surface 2*a* abutting on the side of the connection surface 2*b* closer to the base.

As described earlier, the parallel surface 2*a* is cylindrical parallel to the longitudinal direction Z. An outer diameter of the parallel surface 2*a* is greater than an outer diameter of the mounting screw 24. Further, in the longitudinal cross section, an angle between the pressure contact surface 2*c* and the connection surface 2*b* is greater than an angle between an extension line Lc of the pressure contact surface 2*c* and an extension line La of the parallel surface 2*a*. Here, when multiple parallel surfaces parallel to the longitudinal direction Z are provided on the outer periphery of the housing 2 at positions closer to the base than the pressure contact surface 2*c*, the most tip side parallel surface serves as the parallel surface 2*a* providing the extension line La. Further, a length of the parallel surface 2*a* in the longitudinal direction Z is greater than a distance between the parallel surface 2*a* and the mounting screw 24 in the longitudinal direction Z.

Here, as shown in FIG. 3, a label Φb represents a diameter of a boundary between the connection surface 2*b* and the pressure contact surface 2*c*. The Φb is greater than a standard taper diameter standardized by the ISO 28741: 2013. That is, the ISO 28741:2013 provides a length between a portion of the pressure contact surface 2*c* providing a tapered reference diameter and a predetermined portion of the spark plug in the longitudinal direction Z. With this, an ignition position in the combustion chamber 12 can be determined in the longitudinal direction Z. Hence, the diameter of the outer peripheral edge of the pressure contact surface 2*c* is preferably greater than the standard taper diameter as shown in the below described first table.

Further, when a diameter of the parallel surface 2*a* is Φa and as a solution of a fractional expression (Φa−Φb)/2 is represented by r1 (i.e., a distance between the parallel surface 2*a* and the outer peripheral edge of the pressure contact surface 2*c* in the radial direction 9), the r1 preferably satisfies the below described inequation:

$$0.2\ \text{mm} \le r1 \le 0.75\ \text{mm}.$$

That is, since a depth of a dent possibly formed on the substrate corner 43 of the housing substrate 4 during barrel metal plating is less than 0.2 mm as described later, formation of the dent on the pressure contact surface 2*c* can be easily prevented by setting the length of r1 to be 0.2 mm or more.

Further, as shown in the below described first table, the ISO 28741: 2013 also provides values of Φa and Φc (a standard taper diameter) corresponding to diameters of the mounting screws 24 are M12 and M14, respectively. In the first table, the standard taper diameter described earlier is represented by Φc. Also, an equality (Φa −Φc)/2=r2 is calculated based on the values Φa and Φc provided by the ISO 28741:2013 is shown in the first table. Hence, the value r2 can be the allowable maximum value of the value r1 capable of securing sealability between the pressure contact surface 2*c* and the seat surface 11*f* in conformity to the ISO 28741: 2013.

| | M12 | M14 |
|---|---|---|
| Φa mm | 13.4 to 14.3 | 15.5 to 16.0 |
| Φc mm | 12.8 | 14.8 |
| r2 mm | 0.3 to 0.75 | 0.35 to 0.6 |

As can be seen from the first table, the value (Φa −Φc)/2 always exceeds a range of r2 allowed by the ISO 28741: 2013 when the value r1 exceeds 0.75 mm. Thus, the value r1 is desirably 0.75 mm or less. Further, because the value r2 does not exceed the allowable range determined by the ISO 28741:2013, the value r1 is more preferably 0.3 mm or less.

Further, as shown in FIG. 4, a step 21 is formed on a boundary between the parallel surface 2*a* and the connection surface 2*b*. The step 21 is prepared after the connection surface 2*b* is prepared by surface pressing as described later. In the drawings other than FIG. 4, the step 21 is omitted for simplicity. Further, as shown in FIG. 1, the housing 2 has a tool engaging portion 22 between the parallel surface 2*a* and the base.

The tool engaging portion 22 has a hexagonal outer shape when viewed in the longitudinal direction Z. Further, as shown in FIG. 1, the housing 2 has a caulked portion 25 between the tool engaging portion 22 and the base. Hence, to screw the spark plug 1 into the female screw 111 of the cylinder head 11, a hexagonal wrench is engaged with an outer periphery of the tool engaging portion 22 to almost cover the outer periphery and is turned around an axis thereof. Further, as shown in FIG. 1, the housing 2 has a caulked portion 25 between the tool engaging portion 22 and the base.

Specifically, the caulked portion 25 is pressure joined by pressure applied toward the tip side. Specifically, the caulked portion 25 is pressure joined to a porcelain insulator 3 described later in detail. Although not shown in the drawings, the caulked portion 25 can be pressure joined to the porcelain insulator 3 through a separate member disposed between the porcelain insulator 3 and the housing 2.

Specifically, the porcelain insulator 3 is held inside of the housing 2. The porcelain insulator 3 is cylindrical and made of insulation material such as alumina, etc. Further, the housing 2 has a housing protrusion 23 radially projecting inward. Hence, the porcelain insulator 3 is supported by the housing protrusion 23 from below the porcelain insulator 3 at its portion closer to the tip end. However, the porcelain insulator 3 can be supported by the housing protrusion 23 via a separate annular member.

A tip of the porcelain insulator 3 protrudes from a tip of the housing 2. A porcelain step 31 is formed radially inside of the porcelain insulator 3. A diameter of an inner periphery of the porcelain insulator 3 closer to the tip side than the porcelain step 31 is smaller than that of the porcelain insulator 3 closer to the base than the porcelain step 31. Hence, the porcelain step 31 of the porcelain insulator 3 supports the central electrode 17, thereby holding the central electrode 17 inside of the porcelain insulator 3.

Specifically, the central electrode 17 is composed of a cylindrical body made of conductive material such as Ni-based alloy, etc., and accommodates metal such as Cu, etc., with excellent thermal conductivity. A tip of the central electrode 17 protrudes from a tip of the porcelain insulator 3. On one side of the central electrode 17 closer to the base in an interior of the porcelain insulator 3, a resistor 14 is disposed via a conductive glass seal 13.

Specifically, the resistor 14 is prepared by heating a resistor composition composed of resistor material, such as carbon, ceramic powder, etc., and glass powder. The resistor composition is simultaneously enclosed adhering to the central electrode 17. Otherwise, the resistor 14 can be prepared by inserting a cartridge type resistor. The glass seal 13 is composed of copper glass prepared by mixing copper powder with glass. Further, a terminal metal 15 is disposed closer to the base than the resistor 14 is while connecting to the glass seal 13. The terminal metal 15 may be composed of iron alloy.

Further, a ground electrode 16 is connected to a tip surface of the housing 2. Specifically, a discharge gap G is formed between the ground electrode 16 and the central electrode 17. A part of the ground electrode 16 faces the tip surface of the central electrode 17 in the longitudinal direction Z. Hence, the discharge gap G formed between the tip surface of the central electrode 17 and the ground electrode 16 extends along the direction Z.

Now, with reference to FIGS. 6 to 11, an exemplary method of producing a spark plug 1 for internal combustion engine use according to this embodiment is described. The method of producing the spark plug 1 of this embodiment includes a preparation step, a barrel metal plating step and a processing step.

Figure 6:
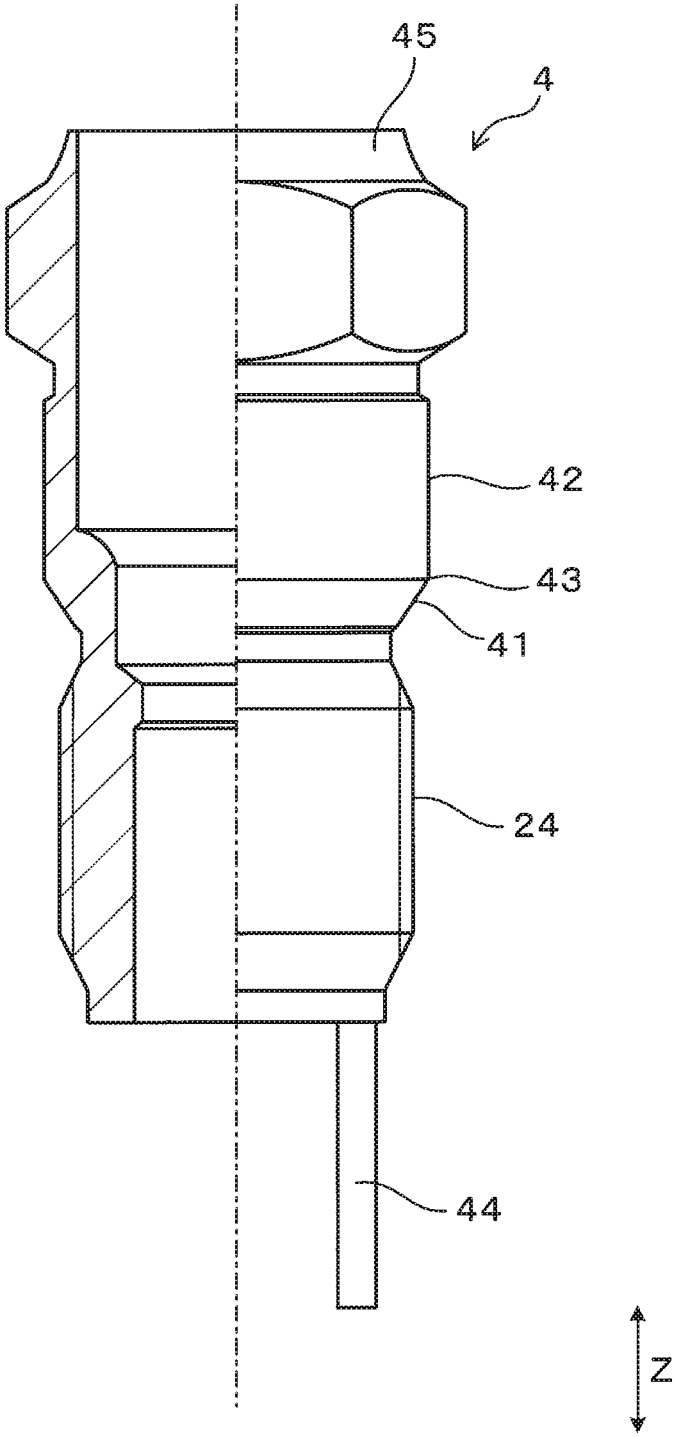
FIG. 6 is a partial cross-sectional front view illustrating a housing substrate included in the spark plug of the first embodiment before it is subjected to a barrel metal plating process.

First, in the preparation step, a housing substrate 4 is prepared. As shown in FIG. 6, the housing substrate 4 includes: an inclined surface 41 inclined radially outward toward the base. A part of the inclined surface 41 provides (i.e., becomes) a pressure contact surface 2*c*. The housing substrate 4 also includes: a cylindrical surface 42 formed parallel to the longitudinal direction Z from an outer peripheral edge of the inclined surface 41 toward the base. A part of the cylindrical surface 42 provides (i.e., becomes) a parallel surface 2*a*.

The housing substrate 4 is produced by applying cold forging and cutting processes to material such as iron, etc., constituting the housing 2. At least a rolling process is also applied to a mounting screw 24. It is noted here that a surface of the housing substrate 4 is not plated, in contrast to the housing 2. Further, before it is caulked, a portion of a base 45 of the housing substrate 4 to provide a caulked portion (see a reference numeral 25 in FIG. 1) is cylindrical and parallel to the longitudinal direction Z.

Further, a ground electrode substrate 44 is connected to a tip of the housing substrate 4. Specifically, the ground electrode substrate 44 has a liner columnar shape and is extended in the longitudinal direction Z. Hence, by bending a tip side of the ground electrode substrate 44 toward a radially inside, an L-shaped ground electrode (see reference numeral 16 in FIG. 1) is formed.

Figure 7:
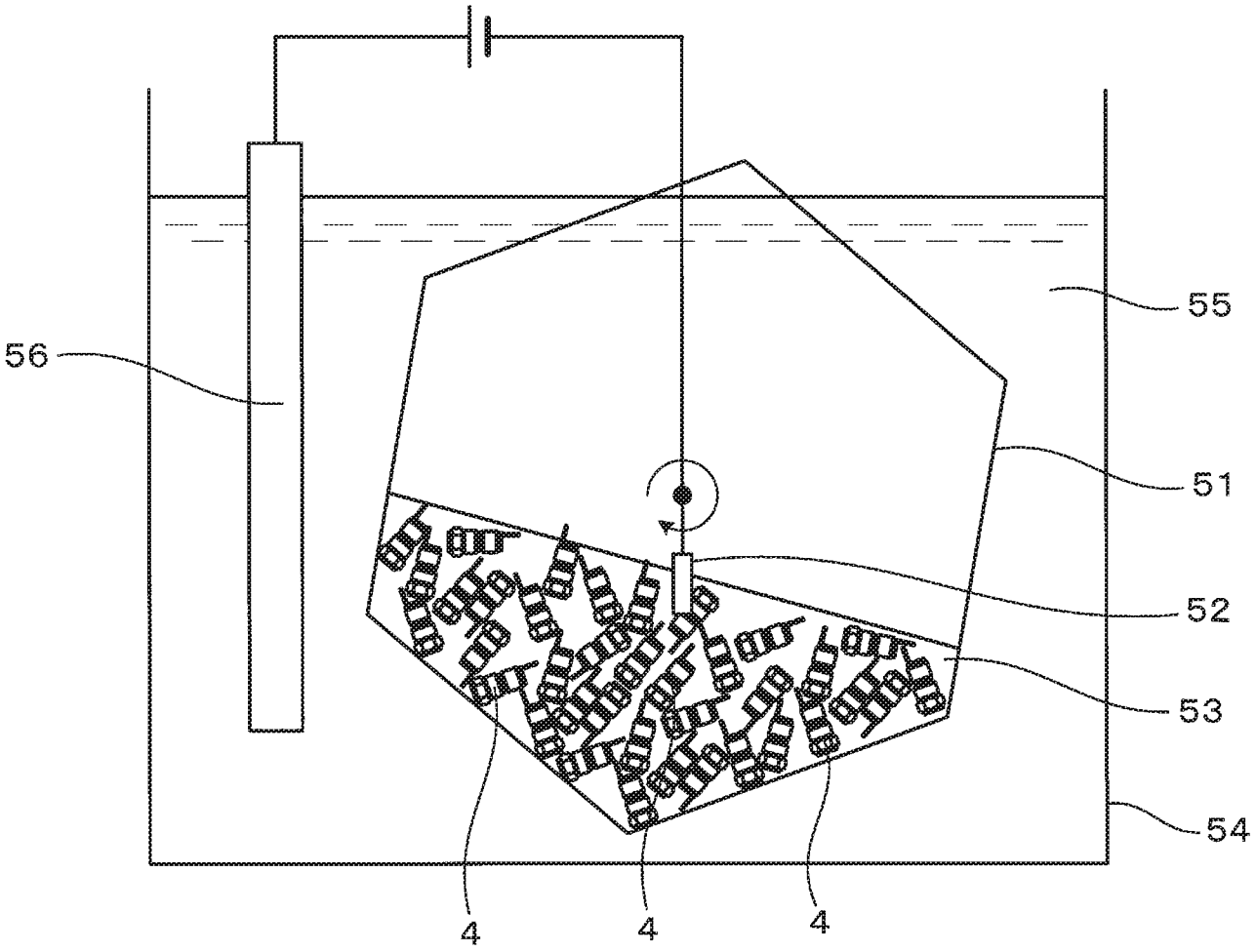
FIG. 7 is a schematic diagram illustrating the barrel metal plating process executed to produce the spark plug of the first embodiment.

Further, as shown in FIG. 7, after completing the preparation step, a barrel metal plating step is performed to apply barrel metal plating to the housing substrate 4. In the barrel metal plating process, a known barrel metal plating system can be adopted.

Specifically, in the barrel metal plating step, in a barrel 51 serving as a bucket-shape container, a cathode 52, multiple housing substrates 4 and multiple barrel plating media 53 are installed. The barrel 51 is then soaked in plated solution 55 filled in a metal plating tank 54. Although not shown, the barrel 51 has holes in a wall thereof to allow the metal plating solution 55 to penetrate into the barrel 51 through the holes. The barrel plating media 53 is spherical and made of metal. Hence, each of the multiple housing substrates 4 is electrically connected to the cathode 52 through the barrel plating media 53.

Further, an anode 56 is also placed in the metal plating tank 54. Then, the barrel 51 is rotated around a central axis of the barrel 51 while applying a voltage between the anode 56 and the cathode 52. Thus, the large number of housing substrates 4 and the barrel plating media 53 are stirred in the barrel 51, so that surfaces of the housing substrates 4 can be substantially equally plated.

Figure 8:
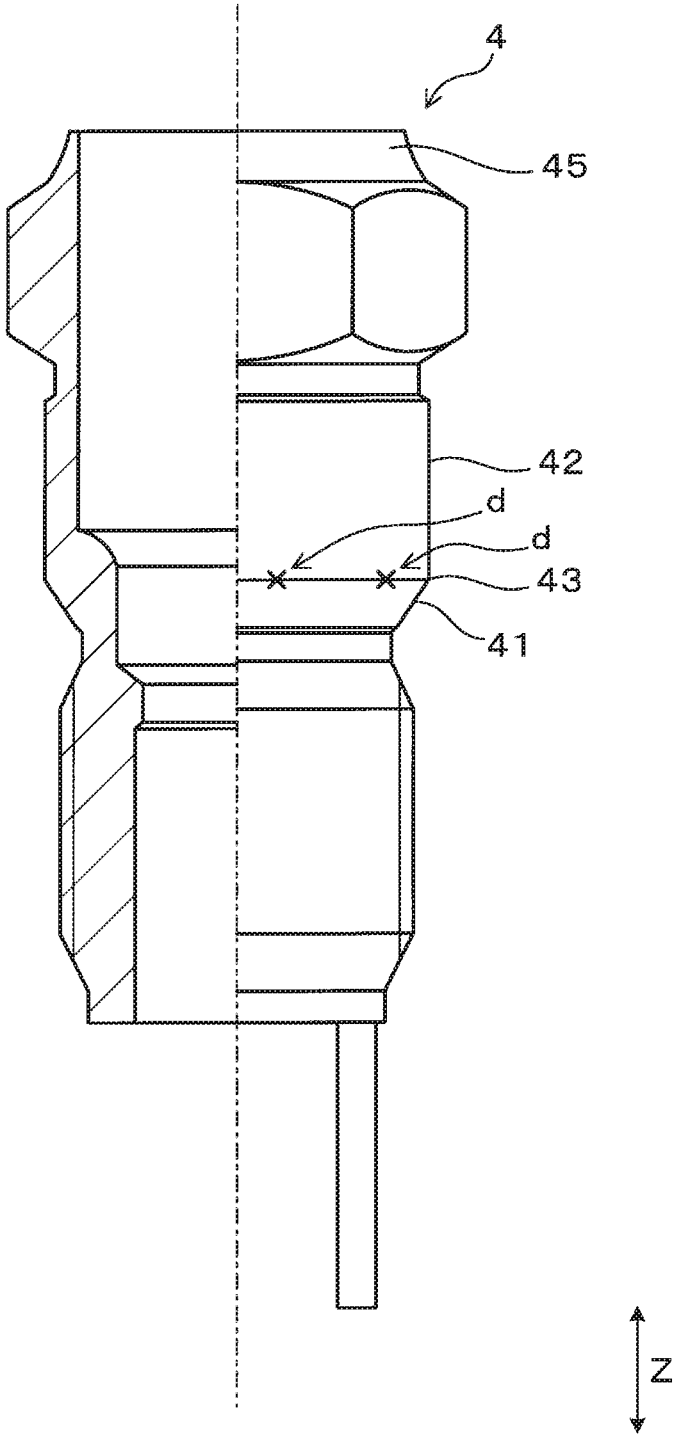
FIG. 8 is a partial cross-sectional front view illustrating the housing substrate of the spark plug of the first embodiment completing the barrel metal plating process.

FIG. 8 shows the housing substrate 4 after completing the barrel metal plating step, in which multiple housing substrates 4 and barrel plating media 53 are stirred in the barrel 51. As shown, a dent d is generated in the barrel metal plating step at a position on a substrate corner 43 of the housing substrate 4 between the cylindrical surface 42 and the inclined surface 41 as indicated by an intersection of a cross mark. However, in FIG. 8, illustration of a metal plated portion on the surface of the housing substrate 4 is omitted.

Here, because it is formed radially at the same position as the cylindrical surface 42, the substrate corner 43 is located radially outside the housing 2. In addition, the substrate corner 43 is angular. As a result, the substrate corner 43 is likely to collide with other housing substrates 4 or the like and is prone to generate a dent d.

After completing the barrel plating step, an assembly step of attaching components, such as the porcelain insulator 3, the central electrode 17, etc., to the housing substrate 4 is performed to be held inside of the housing 2. Specifically, in the assembly step, the porcelain insulator 3 accommodating the central electrode 17, the glass seal 13, the resistor 14 and the terminal metal 15 are inserted into the housing substrate 4 from the base of the housing substrate 4. Then, the base 45 of the housing substrate 4 is caulked to the porcelain insulator 3 by pressing the base 45 toward the tip side while deforming the base 45 radially inward. At the same time, the L-shaped ground electrode 16 is prepared by bending a central portion of the ground electrode substrate 44. Here, a result of the assembly step assembling the housing substrate 4 and the porcelain insulator 3 or the like is shown in an upper side in FIG. 9.

Figure 9:
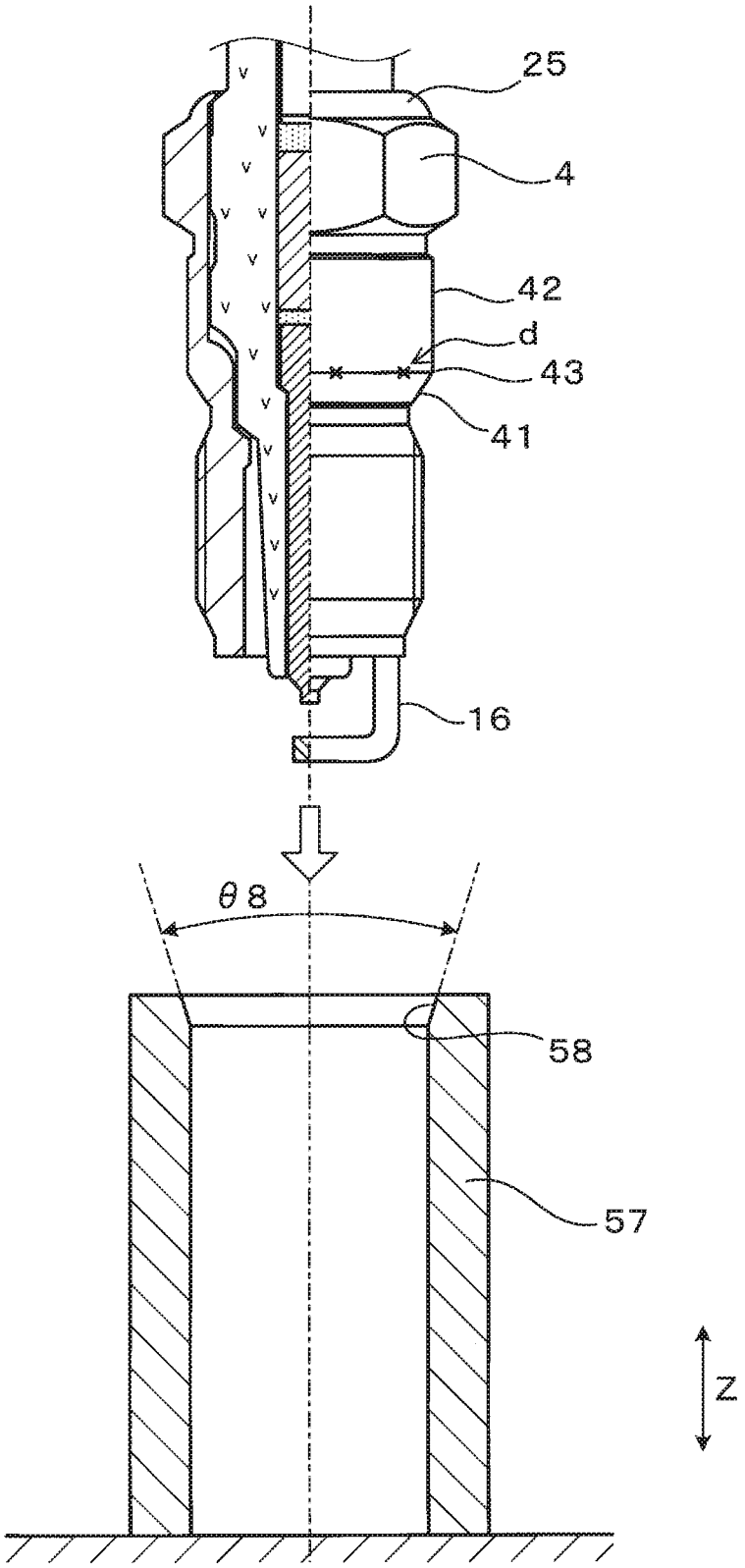
FIG. 9 is a partial cross-sectional front view illustrating a processing step in which the housing substrate of the first embodiment and a porcelain insulator or the like are assembled and are collectively inserted into a supporting jig.

After completing the barrel plating step and the assembly step, a processing step is performed as shown in FIG. 9. Specifically, in the processing step, a process such as deburring pressing, etc., is applied to the substrate corner 43 located between the inclined surface 41 and the cylindrical surface 42 of the housing substrate 4 to change the substrate corner 43 to the connection surface 2*b*, the inclined surface 41 to the pressure contact surface 2*c*, and the cylindrical surface 42 to the parallel surface 2*a*, respectively.

More specifically, as shown in FIG. 9, in the processing step, a tubular supporting jig 57 is used. A supporting surface 58 is formed on an inner periphery of the supporting jig 57 at a portion thereof closer to the base. The supporting surface 58 has a tapered shape that widens toward the base. A taper angle θ8 of the supporting surface 58 is substantially the same as a taper angle θb formed by the connection surfaces 2*b*. That is, the taper angle θ8 of the supporting surface 58 is less than the angle of 59 degrees.

Further, an inner diameter of the supporting surface 58 is smaller than a diameter of the substrate corner 43, and an outer diameter of the supporting surface 58 is greater than the diameter of the substrate corner 43. Thus, when the housing substrate 4 holding the porcelain insulator 3 or the like is inserted into the supporting jig 57 from the base of the supporting jig 57, the substrate corner 43 of the housing substrate 4 contacts the supporting surface 58 of the supporting jig 57.

Figure 10:
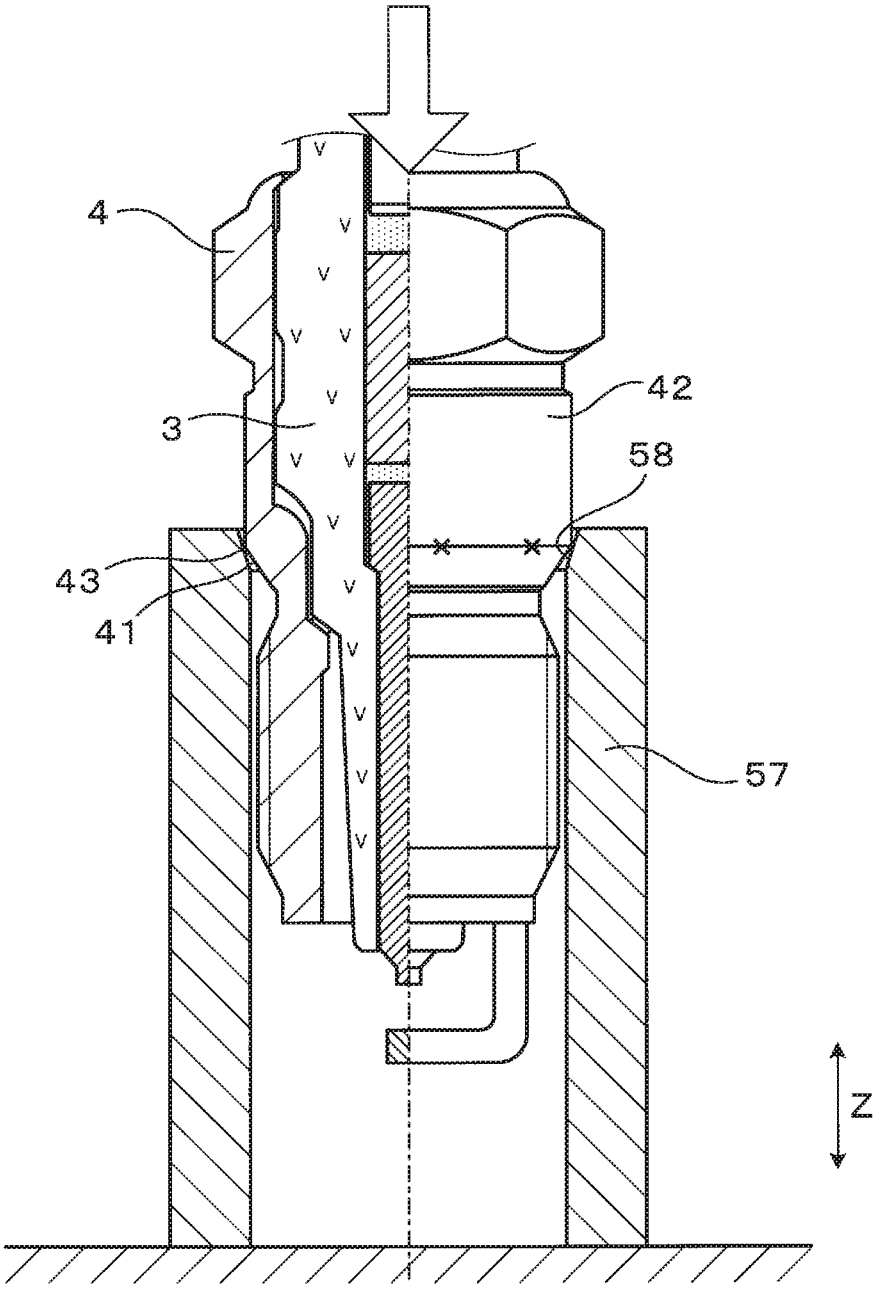
FIG. 10 is a partial cross-sectional front view illustrating a state of the housing substrate of the spark plug of the first embodiment when a substrate corner formed in the housing substrate is pressed against a supporting face formed in the supporting jig during the processing step.
Figure 11:
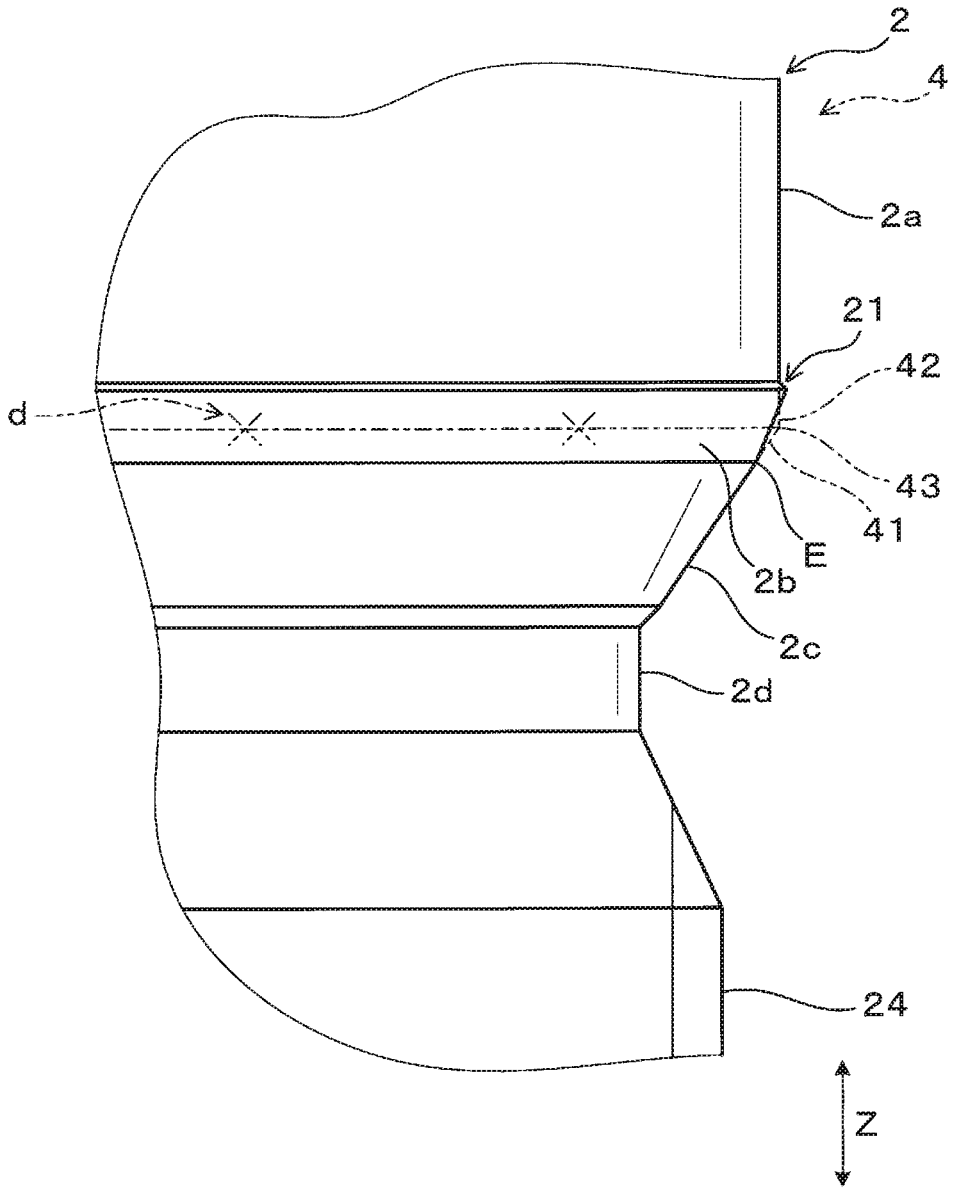
FIG. 11 is an enlarged front view illustrating the connection surface of the housing substrate of the spark plug of the first embodiment and its surroundings completing the processing step.

Hence, as shown in FIG. 10, in the processing step, the housing substrate 4 holding the porcelain insulator 3 or the like is inserted into the supporting jig 57 until the substrate corner 43 contacts the supporting surface 58. From this state, the housing substrate 4 is further pressed against the supporting jig 57 toward the tip side. As a result, as shown in FIG. 11, since the substrate corner 43 located between the inclined surface 41 and the cylindrical surface 42 of the housing substrate 4 is plastically deformed by the surface pushing, the substrate corner 43 is changed to a tapered connection surface 2*b*.

Further, a portion not deformed by the surface pressing in the inclined surface 41 corresponds to the pressure contact surface 2*c*. A portion not deformed by the surface pressing in the cylindrical surface 42 corresponds to the parallel surface 2*a* as well.

Here, since the substrate corner 43 is made into the tapered connection surface 2*b* by the surface pressing, the pressure contact surface 2*c* is necessarily formed further radially inside of the housing substrate 4 than a position at which the substrate corner 43 is previously located. Thus, the pressure contact surface 2*c* can be formed further radially inside of the housing substrate 4 than a position of the dent d conventionally formed on the substrate corner 43. Thus, the pressure contact surface 2*c* formed after completing the processing step can prevent it from having the dent d.

Further, after completing the processing step, a new corner E is formed over the entire circumference of the spark plug 1 between the pressure contact surface 2*c* and the connection surface 2*b*. The corner E includes the outer peripheral edge of the pressure contact surface 2*c* pressed against the seat surface 11*f* of the cylinder head 11 when the spark plug 1 is attached to the internal combustion engine. However, as described above, since the pressure contact surface 2*c* is disposed further radially inside the substrate corner 43 previously present in the housing substrate 4 and the corner E is also located further radially inside the substrate corner 43. Thus, the new corner E can also be prevented from having dent d as well.

Further, in the processing step, the above-described step 21 is formed by the surface pressing at the boundary between the parallel surface 2*a* and the connection surface 2*b*. Due to presence of the step 21, it is recognized that the connection surface 2*b* is formed by the surface pressing in the processing step. Accordingly, the spark plug 1 according to this embodiment can be effectively produced.

Now, various advantages obtainable in this embodiment are herein below described. First, in the spark plug 1 for the internal combustion engine use, the pressure contact surface 2*c* pressed against the cylinder head 11 is connected to the parallel surface 2*a* via the connection surface 2*b* and located further radially inside the parallel surface 2*a*. Thus, the outer peripheral edge of the pressure contact surface 2*c* in close contact with the cylinder head 11 can be positioned further radially inside the parallel surface 2*a* of housing 2. Thus, during a manufacturing process of manufacturing the spark plug 1 and transportation of the spark plug 1 after manufacturing thereof, other objects rarely interfere with the outer peripheral edge of the pressure contact surface 2*c*, so that dents are rarely generated on the outer peripheral edge of the pressure contact surface 2*c*. Accordingly, adhesion between the outer peripheral edge of the pressure contact surface 2*c* and the cylinder head 11 can be satisfactorily maintained, and accordingly airtightness between the spark plug 1 and the cylinder head 11 can be easily ensured.

Further, the connection surface 2*b* connecting the outer peripheral end of the pressure contact surface 2*c* to the tip of the parallel surface 2*a* is located within the region closer to the base than the extension lines Lc extended along and away from the pressure contact surface 2*c* in the longitudinal cross-section. Thus, since the connection surface 2*b* does not hit the cylinder head 11, the pressure contact surface 2*c* can be highly likely to contact the cylinder head 11, so that adhesion between the pressure contact surface 2*c* and the cylinder head 11 can be easily ensured.

Further, in the longitudinal cross-section, the connection surface 2*b* is linearly radially inwardly inclined toward the tip side of the spark plug 1. Thus, the new corner E appears between the outer peripheral edge of the pressure contact surface 2*c* and the connection surface 2*b*. Accordingly, when the outer peripheral edge of the pressure contact surface 2*c* is pressed against the seat surface 11*f* of the cylinder head 11, due to presence of the corner E between the pressure contact surface 2*c* and the connection surface 2*b*, a portion in the pressure contact surface 2*c* (actually) pressed against the seat surface 11*f* can be immediately recognized. Thus, after the spark plug 1 is fabricated, it is easy to confirm whether the dent is formed at a portion of the pressure contact surface 2*c* pressed against the seat surface 11*f*.

Further, the connection taper angle θb is less than 59-degrees. That is, as described earlier, the connection taper angle θb is smaller than the minimum value of the seat surface taper angle θf of the cylinder head 11 defined by the international standard ISO 28741:2013 (i.e., 60 degrees +0/−1 degrees). Thus, when the spark plug 1 is attached to the internal combustion engine, the connection surface 2*b* can prevent interference with the seat surface 11*f*. That is, since the pressure contact surface 2*c* can be highly likely to pressure contact the seat surface 11*f*, sealing property between the pressure contact surface 2*c* and the seat surface 11*f* can be further effectively ensured.

Further, according to this embodiment, the manufacturing method of manufacturing the spark plug 1 used in the internal combustion engine has the barrel plating step of applying barrel plating to the housing substrate 4 having the inclined surface 41 and the cylindrical surface 42. Thus, productivity of the housing 2 can be enhanced while reducing the cost for plating the housing 2. Further, since the surface of the housing substrate 4, in particular the surface of the substrate corner 43 located between the inclined surface 41 and the cylindrical surface 42 has a corner closer to the outer periphery of the housing substrate 4, a dent can be undesirably generated.

Thus, according to this embodiment, the manufacturing method of manufacturing the spark plug 1 has a processing step of applying deburring processing to the substrate corner 43 located between the inclined surface 41 and the cylindrical surface 42 in the housing substrate 4 to change the substrate corner 43 to the connection surface 2*b*, the inclined surface 41 to the pressure contact surface 2*c*, and the cylindrical surface 42 to the parallel surface 2*a*, respectively, after completing the barrel plating step. Thus, even if the dent is accidentally generated in the substrate corner 43 in the barrel plating process, since the pressure contact surface 2*c* formed after the processing step is located radially inner side than the substrate corner 43, the pressure contact surface 2*c* can be prevent from having a dent. Thus, in the manufacturing method of manufacturing the spark plug 1 in this embodiment, adhesion between the outer peripheral edge of the pressure contact surface 2*c* and the cylinder head 11 can be easily ensured, and accordingly airtightness between the spark plug 1 and the cylinder head 11 can be easily ensured as well.

As described heretofore, according to this embodiment, a spark plug for internal combustion engine use is capable of ensuring airtightness between the spark plug and the cylinder head.

Figure 12:
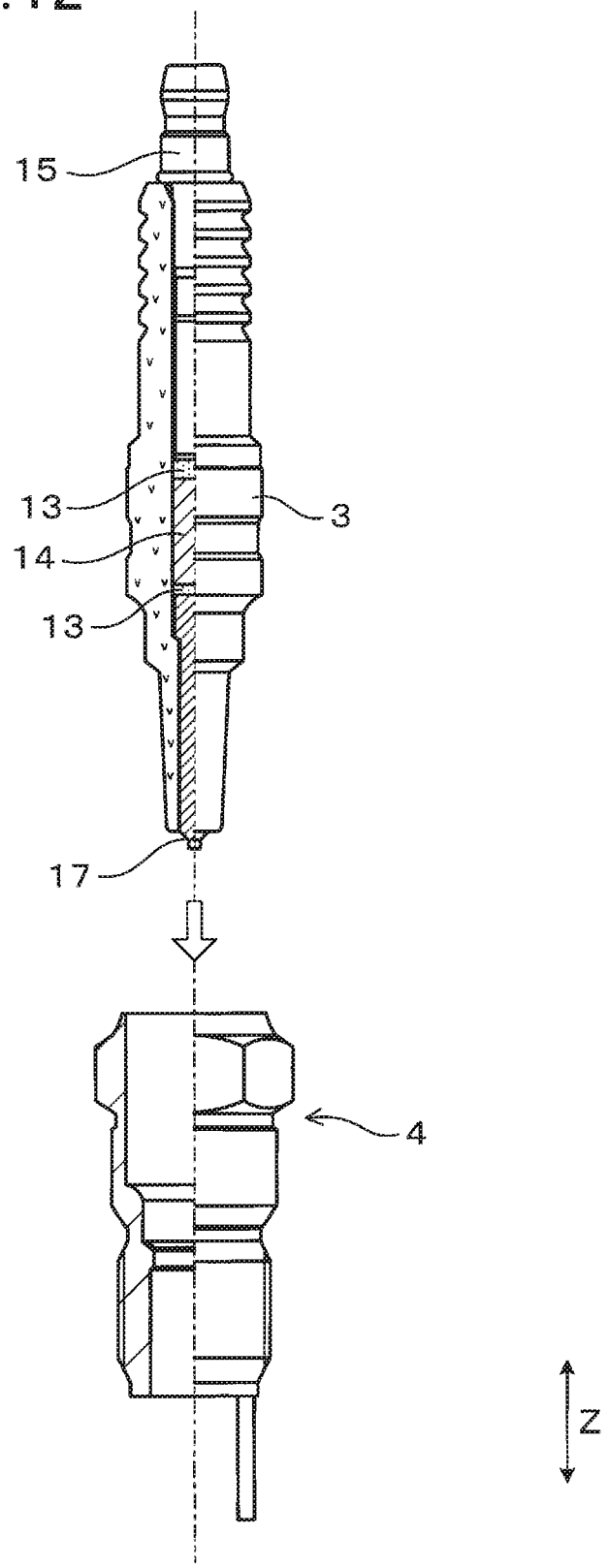
FIG. 12 is a partial cross-sectional front view illustrating a state of a porcelain insulator accommodating a central electrode or the like when it is inserted into the housing substrate of the spark plug during an insertion step according to a second embodiment.

Now, a second embodiment of the present disclosure is described with reference to FIGS. 12 to 14, in which a manufacturing method of manufacturing the spark plug is modified.

The method of manufacturing the spark plug 1 according to the second embodiment includes a preparation step, a barrel plating step, and an insertion step. The method further includes a first contacting step, a second contacting step and a simultaneous processing step as well. The preparation step and the barrel plating step in this embodiment are substantially the same as employed in the first embodiment.

However, in this embodiment, the insertion step is carried out after the barrel plating step. Specifically, as shown in FIG. 12, in the insertion step, the porcelain insulator 3 accommodating the central electrode 17, the glass seal 13, the resistor 14 and the terminal metal 15 is inserted into the housing substrate 4, thereby forming an assembly 10 shown in FIG. 13. Further, after completing the insertion step, the first contacting step and the second contacting step are performed as described below.

Figure 13:
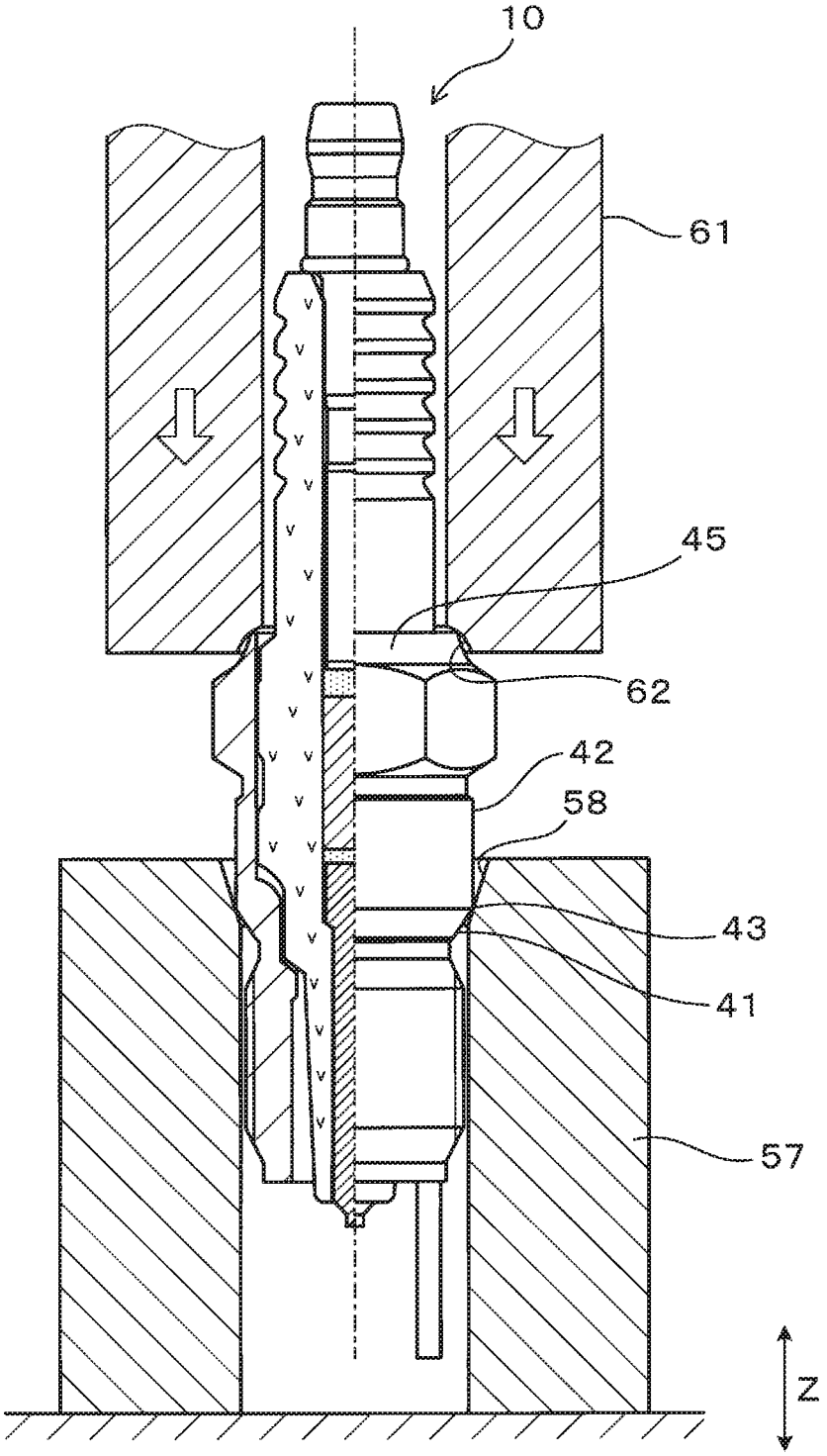
FIG. 13 is a partial cross-sectional front view illustrating the supporting jig, a caulking jig and an assembly completing first and second contacting steps executed according to the second embodiment.
Figure 14:
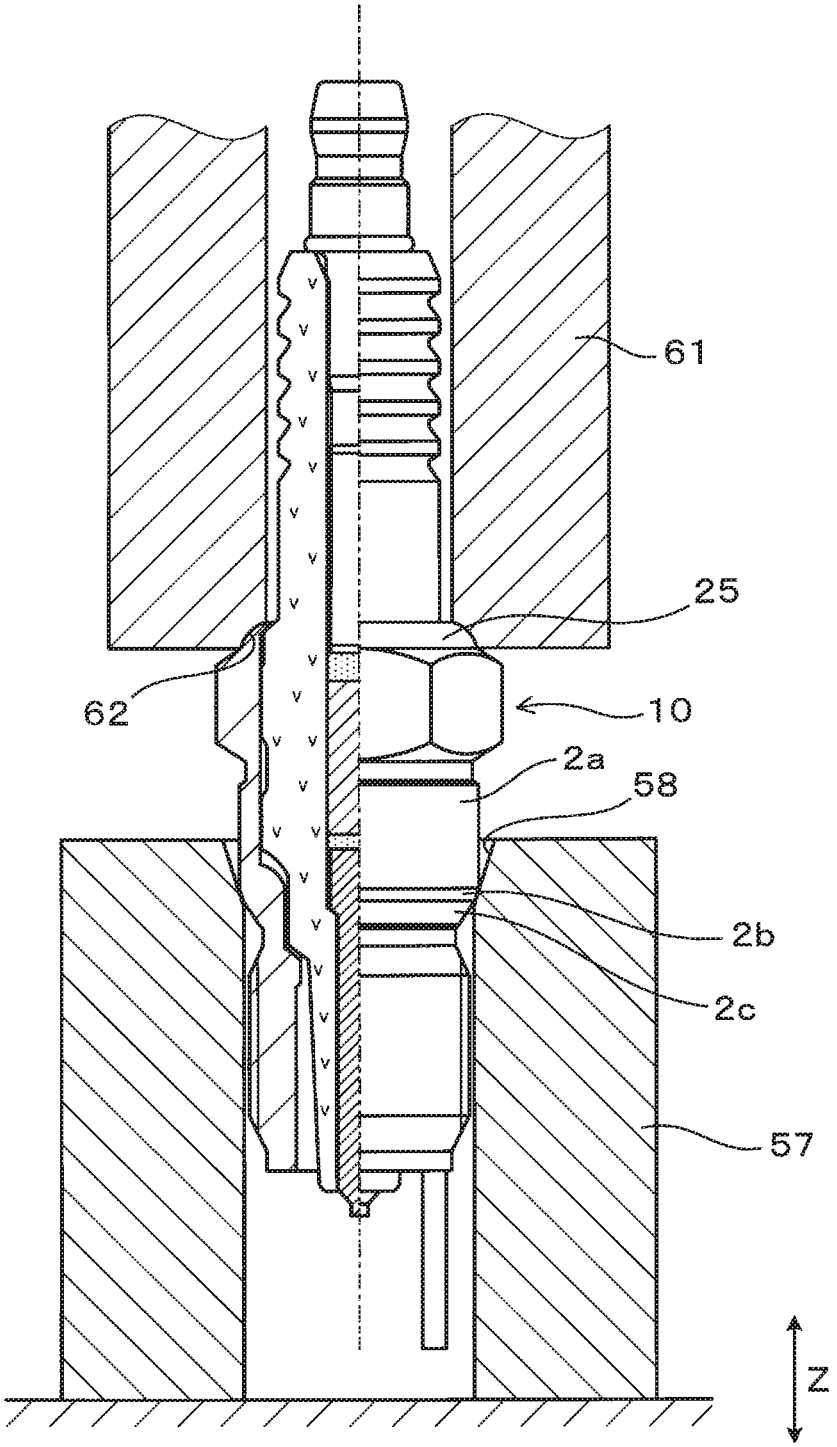
FIG. 14 is a partial cross-sectional front view illustrating the supporting jig, the caulking jig and the assembly after completing a simultaneous processing step according to the second embodiment.

Specifically, as shown in FIG. 13, in the first contacting step, the substrate corner 43 located between the inclined surface 41 and the cylindrical surface 42 of the assembly 10 is inserted into the supporting jig 57 from one side of the supporting surface 58 thereof closer to the base and contacts the supporting surface 58. That is, the assembly 10 is inserted into the supporting jig 57 from one side of the supporting jig 57 closer to the base, so that the substrate corner 43 of the housing substrate 4 can contact the supporting surface 58. The supporting jig 57 and the supporting surface 58 of this embodiment are substantially the same as those employed in the first embodiment.

Further, in the second contacting step, a caulking jig 61 having a cylindrical shape contacts a base 45 of the housing substrate 4 from above the base. The caulking jig 61 has a jig contacting surface 62 at a tip of in its inner periphery. A diameter of the inner periphery increases toward the tip side. The jig contacting surface 62 is formed over the entire circumference of the inner periphery of the caulking jig 61. In a cross-section including a plug central axis parallel to the longitudinal direction Z, the jig contacting surface 62 has an arc shape tightly fitting an outer periphery of the caulked portion 25 of the housing 2 obtained after the caulking process. Further, after completing the first contacting step and the second contacting step, a simultaneous process is performed as described below.

Specifically, in the simultaneous processing step, a compressive force in the longitudinal direction Z is applied to the housing substrate 4 by bringing the supporting jig 57 and the caulking jig 61 close to each other in the longitudinal direction Z. Hence, the base 45 of the housing substrate 4 is plastically deformed by the compressive force thereby forming the caulked portion 25 as shown in FIG. 14. Further, at the same time when the caulked portion 25 is formed by the compressive force, the substrate corner 43 is pressed against the supporting surface 58 by the compressive force to deburr the surface thereof. As a result, the substrate corner 43 is plastically deformed to form the connection surface 2*b* facing the supporting surface 58 while changing the inclined surface 41 and the cylindrical surface 42 to the pressure contact surface 2*c* and the parallel surface 2*a*, respectively.

That is, in the simultaneous processing step, the caulked portion 25 and the connection surface 2*b* are formed at the same time by bringing the supporting jig 57 and the caulking jig 61 close to each other in the longitudinal direction Z and thereby generating compressive force applied from the supporting jig 57 and the caulking jig 61 to act on the housing substrate 4 in the longitudinal direction Z. As a result, a portion in the inclined surface 41 not deformed by the surface pressing corresponds to (i.e., serves as) the pressure contact surface 2*c*. A portion in the cylindrical surface 42 not deformed by the surface pressing corresponds to (i.e., serves as) the parallel surface 2*a*. Hence, as described heretofore, the spark plug 1 of this embodiment can be effectively preferably produced.

Further, a configuration and operation of the spark plug 1 of this embodiment is substantially the same as employed in the first embodiment.

Now, a manufacturing method of manufacturing the spark plug 1 of this embodiment is briefly described herein below. That is, as one of steps of the manufacturing method, the compressive force is applied to the housing substrate 4 in the longitudinal direction Z by bringing the supporting jig 57 and the caulking jig 61 close to each other in the longitudinal direction Z in the simultaneous processing step. Specifically, in the simultaneous compression step, the caulked portion 25 is formed by applying the compressive force and thereby plastically deforming the base 45 of the housing substrate 4. At the same time, with the compression force, the substrate corner 43 is pressed against the supporting surface 58 for deburring, and thereby plastically deforming the substrate corner 43 to form the connection surface 2*b* facing the supporting surface 58 while changing the inclined surface 41 and the cylindrical surface 42 to the pressure contact surface 2*c* and the flat surface 2*a*, respectively. In this way, in the simultaneous processing step, by bringing the supporting jig 57 and the caulking jig 61 close to each other in the longitudinal direction Z, the caulked portion 25 and the connection surface 2*b* of the housing 2 can be formed at the same time. Thus, productivity of the housing 2 can be effectively enhanced.

Further, also in this embodiment, the manufacturing method of manufacturing the spark plug 1 has a barrel plating step. Thus, productivity of the housing 2 can be enhanced while reducing the cost for plating the housing 2. On the other hand, however, because the surface of the housing substrate 4, in particular, the substrate corner 43 located is located between the inclined surface 41 and the cylindrical surface 42 at a corner formed on a side of the housing substrate 4 closer to its outer periphery, a dent can be generated.

Thus, as described above, also in this embodiment, the manufacturing method of manufacturing the spark plug 1 has the simultaneous processing step performed after the barrel plating step to form the connection surface 2*b* at the substrate corner 43 of the housing substrate 4 and change the inclined surface 41 and the cylindrical surface 42 to the pressure contact surface 2*c* and the parallel surface 2*a*, respectively. Hence, as in the manufacturing method of manufacturing the spark plug 1 in a second aspect, adhesion between the outer peripheral edge of the pressure contact surface 2*c* and the cylinder head 11, and accordingly airtightness between the spark plug 1 and the cylinder head 11 can be easily ensured. Further, substantially the same advantage can be obtained in this embodiment as obtained in the first embodiment.

Figure 15:
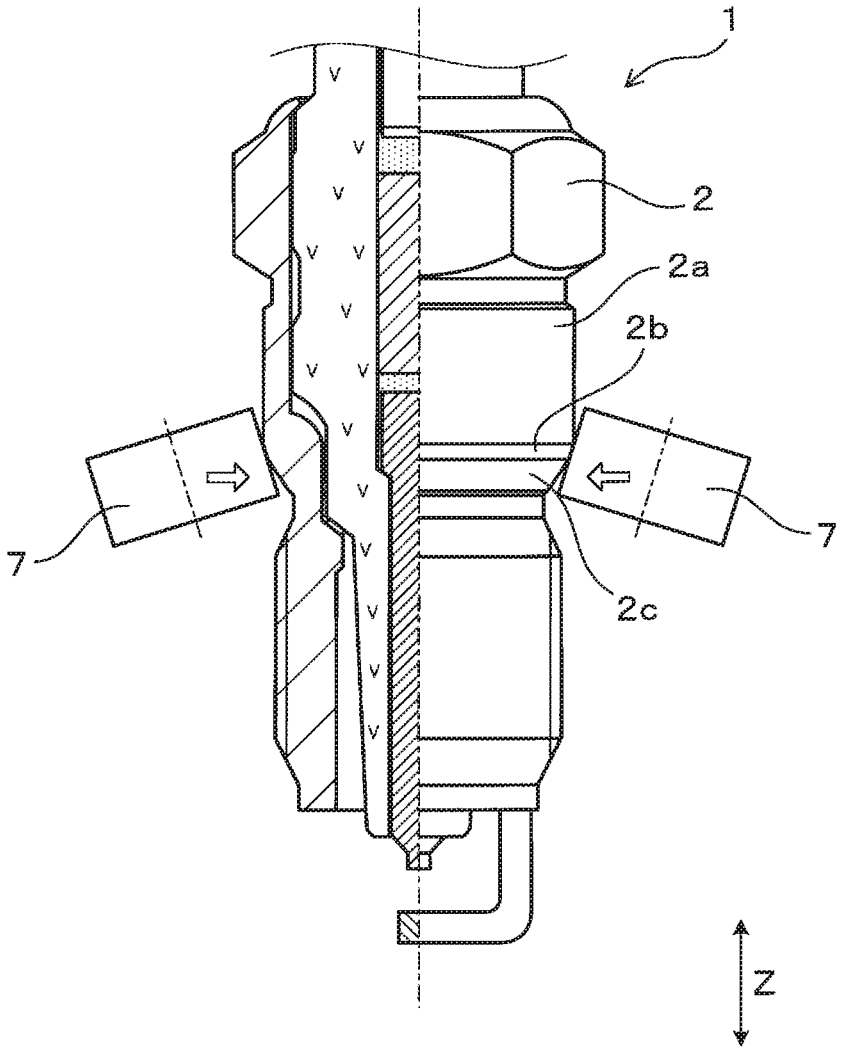
FIG. 15 is a partial cross-sectional front view illustrating a roller rolling process applied to the spark plug by using rollers according to a third embodiment.

Now, a third embodiment of the present disclosure will be described with reference to FIG. 15. As shown in FIG. 15, this embodiment is different from the first embodiment such that a connection surface 2*b* is formed by a different system in this embodiment.

Specifically, in this embodiment, the connection surface 2*b* is formed on the housing substrate 4 by applying roller rolling. To perform the roller rolling, one side of each of multiple rollers 7 is pressed against the substrate corner 43 of the housing substrate 4. Each of the rollers 7 is columnar with a cylindrical side surface. More specifically, the sides of the rollers 7 and the substrate corner (see reference numeral 43 in FIG. 6) of the housing substrate (see reference numeral 4 in FIG. 6) are opposed to each other. Then, by rotating both the rollers 7 and the housing substrate while pressing the rollers 7 against the housing substrate, the substrate corner is plastically deformed to generate the connection surface 2*b*. The connection surface 2*b* is formed over the entire circumference of the spark plug 1.

Here, in this embodiment, the roller rolling is carried out after completing the barrel plating step. Further, the roller rolling can be performed either after or before components such as a porcelain insulator, etc., are accommodated in the housing substrate 4. Further, the substrate corner 43 of the housing substrate 4 can be cut in a cutting process to form a cut surface and serves as the connecting surface. Remaining configurations and operations are substantially the same as in the first embodiment.

Further, in this embodiment, the substantially same advantages can be obtained as obtained in the first embodiment.

Numerous additional modifications and variations of the present disclosure are possible in light of the above teachings. It is therefore to be understood that within the scope of the appended claims, the present disclosure may be executed otherwise than as specifically described herein. For example, the present disclosure is not limited to the above-described spark plug used in an internal combustion engine and may be altered as appropriate. Further, the present disclosure is not limited to the above-described methods of producing a spark plug used in the internal combustion engine and may be altered as appropriate.

What is claimed is:

1. A method of producing a spark plug for an internal combustion engine, the spark plug having a tubular housing, the tubular housing comprising:

a parallel surface formed parallel to the central axis;

a pressure contact surface located closer to a tip of the spark plug than the parallel surface and radially inside an extension line extended along and away from the parallel surface, the pressure contact surface having a tapered portion inclining to the central axis to be pressed against a cylinder head, a diameter of the tapered portion decreasing toward the tip; and a connection surface located closer to a base of the spark plug than an extension line extended along and away from the pressure contact surface to connect an outer peripheral edge of the pressure contact surface with a longitudinal end of the parallel surface;

the method comprising the steps of:

forming an inclined surface on a housing substrate, the inclined surface inclined radially outward from a central axis of the spark plug toward a base of the spark plug as a preparation step, a part of the inclined surface becoming the pressure contact surface;

forming a cylindrical surface on the housing substrate, the cylindrical surface parallel to the central axis from an outer peripheral edge of the inclined surface toward the base as the preparation step, a part of the cylindrical surface becoming the parallel surface;

applying barrel plating to the housing substrate as a barrel plating step after completing the preparation step; and applying machining to a substrate corner caused during the preparation step on a border between the inclined surface and the cylindrical surface until the substrate corner is deformed into the connection surface while the inclined surface and the cylindrical surface are changed to the pressure contact surface and the parallel surface, respectively.

2. The method according to claim 1, wherein the cylinder head includes a seat surface pressure contacted by the pressure contact surface, the seat surface being inclined by a prescribed angle standardized by the ISO.

3. The method according to claim 1, wherein the spark plug is produced by a method including a barrel metal plating process as one of items in which multiple spark plugs are plated at once.

4. The method according to claim 1, wherein the connection surface is linearly inclined to the central axis.

5. The method according to claim 4, wherein a connection taper angle formed by a pair of extension lines extended along and away from the connection surface is less than 59 degrees, the pair of extension lines being defined in a longitudinal cross-section of the spark plug.

6. A method of producing a spark plug for an internal combustion engine, the spark plug having a housing accommodating a cylindrical porcelain insulator, the method comprising the steps of:

forming an inclined surface inclining radially outward of the spark plug toward a base of the spark plug in a preparing step of preparing a housing substrate, a part of the inclined surface becoming a pressure contact surface of the spark plug;

forming a cylindrical surface parallel to a longitudinal direction from an outer peripheral edge of the inclined surface toward the base in the preparing step, a part of the cylindrical surface becoming a parallel surface of the spark plug;

applying barrel plating to the housing substrate in a barrel plating step;

forming an assembly at least by inserting a porcelain insulator into the housing substrate in an insertion step after completing the barrel plating step;

bringing a substrate corner caused during the preparing step on a border between the inclined surface and the cylindrical surface into contact with a supporting surface formed on an inner periphery of a tubular supporting jig inclining parallel to the connection surface in a first contacting step;

bringing a caulking jig into contact with the base of the housing substrate in a second contacting step;

applying a compressive force in a simultaneous processing step to the housing substrate in the longitudinal direction by bringing the tubular supporting jig and the caulking jig close to each other in the longitudinal direction after completing the first contacting step and the second contacting step until the base of the housing substrate is plastically deformed and a caulked portion is formed at the base of the housing substrate by the compressive force; and simultaneously pressing the substrate corner during the simultaneous processing step against the supporting surface by the compressive force until the substrate corner is plastically deformed into the connection surface facing the supporting surface and the inclined surface and the cylindrical surface are changed to the pressure contact surface and the parallel surface, respectively.

* * * * *